US008128508B2

(12) United States Patent
Sato

(10) Patent No.: US 8,128,508 B2
(45) Date of Patent: Mar. 6, 2012

(54) SHAFT SET FOR GOLF CLUBS AND CLUB SET INCLUDING THE SAME

(75) Inventor: Fumiaki Sato, Chichibu (JP)

(73) Assignee: Bridgestone Sports, Co., Ltd., Tokyo (JP)

( * ) Notice: Subject to any disclaimer, the term of this patent is extended or adjusted under 35 U.S.C. 154(b) by 46 days.

(21) Appl. No.: 12/551,785

(22) Filed: Sep. 1, 2009

(65) Prior Publication Data

US 2010/0167833 A1 Jul. 1, 2010

(30) Foreign Application Priority Data

Dec. 26, 2008 (JP) ..... 2008-333282

(51) Int. Cl.
*A63B 53/10* (2006.01)

(52) U.S. Cl. ..... 473/289; 473/319

(58) Field of Classification Search ..... 473/289, 473/316–323

See application file for complete search history.

(56) References Cited

U.S. PATENT DOCUMENTS

2006/0211510 A1* 9/2006 Ashida et al. ..... 473/316

FOREIGN PATENT DOCUMENTS

JP 10225537 A * 8/1998

(Continued)

*Primary Examiner* — Stephen L. Blau

(74) *Attorney, Agent, or Firm* — Sughrue Mion, PLLC

(57) ABSTRACT

A shaft set includes plural shafts used for wood-type golf clubs each having a length of 40 inches to 48 inches. Among the plural shafts, a shaft used for a longer club has a smaller amount of change Δ1 in bending stiffness in a section from 600 mm to 800 mm from a tip of the shaft. Among the clubs using the plural shafts, the amount of change Δ1 in bending stiffness decreases at a constant rate in a range of $0.7\times10^3$ kgf·mm²/mm·inch to $1.6\times10^3$ kgf·mm²/mm·inch per inch increase in club length, and the bending stiffness at a position 800 mm from the tip of the shaft decreases at a constant rate in a range of $0.1\times10^6$ kgf·mm²/inch to $0.4\times10^6$ kgf·mm²/inch per inch increase in club length.

6 Claims, 5 Drawing Sheets

FOREIGN PATENT DOCUMENTS

| | | | | |
|---|---|---|---|---|
| JP | 11-009728 | A | | 1/1999 |
| JP | 11076481 | A | * | 3/1999 |
| JP | 2000279558 | A | * | 10/2000 |
| JP | 2003-144588 | A | | 5/2003 |
| JP | 2004290391 | A | * | 10/2004 |

* cited by examiner

SHAFT SET FOR GOLF CLUBS AND CLUB SET INCLUDING THE SAME

BACKGROUND OF THE INVENTION

The present invention relates to a shaft set for golf clubs and to a club set including the same.

The wood clubs include plural golf clubs ranging from drivers to fairway woods such as the brassie and the spoon, and are formed differently from one another in club length and loft angle so as to provide various driving distances differing depending on the club number. Such a golf club set preferably makes the golfer feel less difference among the club numbers in the actual swing and enables the golfer to swing in the same stance.

For example, Japanese Patent Application Publication No. 11-9728 describes the following technique. Specifically, with a focus on differences in the amount of toe down among the members of a golf club set allowing the same head speed, a toe down ratio is set at an almost constant value between each two wood golf clubs of adjacent numbers of a wood golf club set composed of plural wood golf clubs allowing the same head speed. This publication also states that the technique reduces the difference in swing feel among the clubs of adjacent numbers, and also that the technique allows the golfer to swing in the same stance.

In addition, Japanese Patent Application Publication No. 2003-144588 states that a sum of vibration frequencies at a tip portion and a rear end portion of a golf club shaft is determined in relation with order of the club number in order to harmonize stiffness that a person actually feels of the shafts of the different golf club numbers.

SUMMARY OF THE INVENTION

In general, the shorter the length of a club, the smaller the whip of the shaft of the club. Thus, the whip of the shaft of such a shorter club returns more rapidly. On the other hand, the greater the length of a club, the larger the whip of the shaft of the club. Thus, the whip of the shaft of such a longer club returns more slowly. Accordingly, the golfer feels difficulty in adjusting the timing of swing according to the length of the club, and as a result, suffers from a problem of being unable to sufficiently exert the characteristics of the length of the club because of the discomfort and insecurity in swinging the club.

In view of the above-mentioned problems, an object of the present invention is to provide a shaft set for golf clubs and a golf club set including the shaft set, the shaft set achieving ease in adjusting a timing of swing even with the golf clubs having different lengths.

In order to achieve the above-described object, a shaft set for golf clubs according to the present invention comprises plural shafts used for wood type-golf clubs each having a club length of 40 inches to 48 inches. Among the plural shafts, a shaft used for a longer club has a smaller amount of change Δ1 in bending stiffness in a section from 600 mm to 800 mm from a tip of the shaft. Among the clubs using the plural shafts, the amount of change Δ1 in bending stiffness decreases at a constant rate in a range of $0.7\times10^3$ kgf·mm$^2$/mm·inch to $1.6\times10^3$ kgf·mm$^2$/mm·inch per inch increase in club length, and the bending stiffness at a position 800 mm from the tip of the shaft decreases at a constant rate in a range of $0.1\times10^6$ kgf·mm$^2$/inch to $0.4\times1^{06}$ kgf·mm$^2$/inch per inch increase in club length.

In addition, in the shaft set for golf clubs according to the present invention, it is preferable that the plural shafts respectively have tip stiffnesses sequentially increasing in such a manner that a shaft used for a longer club has a higher tip stiffness, and that, among the clubs using the plural shafts, the tip stiffness of the shaft increase at a constant rate in a range of $0.05\times10^6$ kgf·mm$^2$/inch to $0.15\times10^6$ kgf·mm$^2$/inch per inch increase in club length. Moreover, in the shaft set for golf clubs according to the present invention, it is preferable that the plural shafts respectively have shaft weights sequentially decreasing in such a manner that a shaft used for a longer club has a smaller shaft weight, and that, among the clubs using the plural shafts, the shaft weight decrease at a constant rate in a range of 1.5 g/inch to 7.0 g/inch per inch increase in club length.

A golf club set according to the present invention comprises plural golf clubs each having a length of 40 inches to 48 inches, the plural golf clubs comprising the above-described shaft set. In addition, in the golf club set according to the present invention, it is preferable that, among the plural clubs, a shaft bending stiffness at a distance of 300 mm from a butt end of each club toward a tip thereof decrease at a constant rate of not more than $0.02\times10^6$ kgf·mm$^2$/inch per inch increase in club length. Moreover, in the golf club set according to the present invention, it is preferable that the plural clubs respectively have club weights sequentially decreasing in such a manner that a longer club has a lighter club weight, that the club weight decrease at a constant rate in a range of 6.0 g/inch to 9.0 g/inch per inch increase in club length, and that the center of gravity of each of the clubs be located within 75% to 80% of its entire length from the butt end of the club, and also be located at a distance not exceeding 900 mm from the butt end thereof.

Furthermore, in the golf club set according to the present invention, it is preferable that a shaft bending stiffness at a distance of 100 mm from an end face of a hosel toward the butt increase at a constant rate in a range of $0.05\times10^6$ kgf·mm$^2$/inch to $0.15\times10^6$ kgf·mm$^2$/inch per unit club length.

The portion where the golfer feels the shaft of a golf club whips is generally a portion, which becomes sharply flexible, of the shaft. If golf clubs have different lengths, the shafts are significantly different from each other in whipping characteristics. Thus, the golfer feels difficulty in adjusting the timing of swing. According to the shaft set of the present invention, a shaft used for a longer club has a smaller amount of change in bending stiffness in the section from 600 mm to 800 mm from the tip of the shaft; on the other hand, a shaft used for a shorter club has a large amount of change in bending stiffness. Furthermore, the amount of change as well as the stiffness at the position 800 mm from the tip of the shaft are changed at the respective constant rates among the clubs having different lengths. Therefore, it is possible for the golf club set including the shaft set to provide the same swing feel to the golfer with any club number. dr

DETAILED DESCRIPTION OF THE INVENTION

Figure 1:
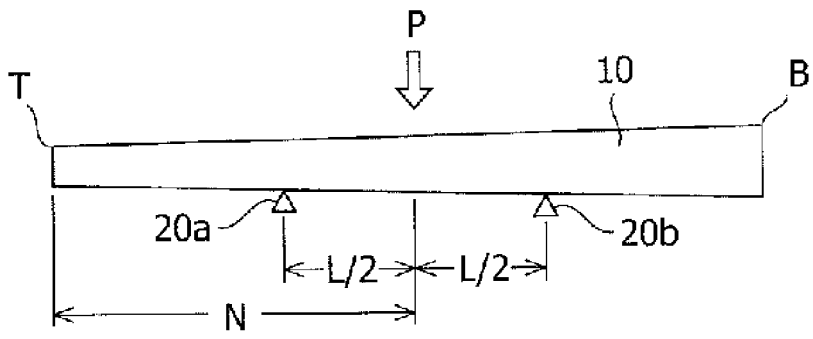
FIG. 1 is a schematic view to explain how to measure the EI value of a shaft.

A shaft set for golf clubs according to the present invention will be described with reference to the accompanying drawings. As shown in FIG. 1, a golf club shaft 10 is in the shape of a cylinder having a diameter that reduces with increasing distance from a butt B to a tip T of the shaft. A club head (not shown) is secured to the tip portion of the shaft 10, and a grip (not shown) is placed over the butt portion of the shaft. The shaft set for golf clubs of the present invention includes plural such shafts having lengths different from one another. The lower limit of the length of each of the shafts 10 preferably is approximately 1000 mm, and more preferably is approximately 1020 mm. On the other hand, the upper limit of the length of each shaft 10 preferably is approximately 1200 mm, and more preferably is approximately 1170 mm.

The bending stiffness value (EI) is the product of the Young's modulus E and the geometrical moment of inertia I, and serves as an index for evaluating the bending stiffness of each part of the shaft 10. The value EI is calculated according to the following equation by performing a three-point bending test. In the three-point bending test, first, the shaft 10 is horizontally supported by a pair of supporters 20 which are spaced apart from each other at a predetermined distance L. Then, a load P is vertically applied to the shaft 10 at the center position between the pair of supporters 20, in other words, at a measurement position of the value EI. In this way, the strain amount σ of the shaft 10 is measured at the measurement position, so that the value EI [kgf·mm$^2$] is obtained. Normally, the distance L between the supporters 20 is set at 300 mm and the load P is set at 20 kg.

$$EI=(L^3/48)\cdot(P/\sigma)$$

L [mm] is the distance between the pair of supporters.

P [kg] is the load applied to the shaft.

σ is the strain amount of the shaft when the load is applied.

The measurement position of the value EI is indicated by a distance N from the tip T of the shaft.

Here, the amount of change in the value EI in a section between 600 mm and 800 mm from the tip T is represented by Δ1. The shafts of the shaft set for golf clubs are formed such that a shaft used for a longer club has a smaller value of Δ1 in the section between 600 mm and 800 mm from the tip T.

In addition, the value Δ1 decreases at a constant rate in a range of $0.7\times10^3$ kgf·mm$^2$/mm·inch to $1.6\times10^3$ kgf·mm$^2$/mm·inch per inch increase in club length among the clubs using the shaft set. The term "at a constant rate" used herein means, for example, the slope of the approximate straight line representing the relationship between the value Δ1 and the length of the club in a single club set or a single shaft set used for the single club set. The lower limit of the amount of change in the value Δ1 per inch increase in club length more preferably is $0.8\times10^3$ kgf·mm$^2$/mm·inch. On the other hand, the upper limit thereof more preferably is $1.5\times1^{03}$ kgf·mm$^2$/mm·inch. The value of bending stiffness at the position 800 mm from the tip of each shaft also decreases at a constant rate in a range of $0.1\times10^6$ kgf·mm$^2$/inch to $0.4\times10^6$ kgf·mm$^2$/inch per inch increase in club length. The value of bending stiffness at the position 800 mm from the tip of the shaft more preferably decreases at a constant rate of not less than $0.15\times10^6$ kgf·mm$^2$/inch per inch increase in club length. On the other hand, as the upper limit, the bending stiffness value at the position 800 mm from the tip of the shaft more preferably decreases at a constant rate of not more than $0.35\times10^6$ kgf·mm$^2$/inch per inch increase in club length. Setting the stiffness at the position 800 mm from the tip of the shaft in such a range as described above is preferable because the variations each between the club numbers are appropriately set so that the swing feel is made uniform.

Setting the rate of change in Δ1 per length of the club and the rate of change in the stiffness at the position 800 mm from the tip of the shaft as described above provides the following effects to the golf club set using the shaft set. If the change in the butt stiffness is reduced, the golfer can feel a uniform whip in a wide region on the butt side of the club, and as a result, feel an excellent stability of the shaft. On the other hand, if the change in the butt stiffness is increased, the whip becomes large in a portion on the tip side of the shaft, so that the golfer can feel an excellent whip of the shaft. In particular, this case is preferable because the kick point can be a low kick point. It should be noted that the term "low kick point" used herein means that the position of the maximum flexure under load applied to the shaft from both ends thereof is located at a distance of 41.5% or less of its entire length from the tip of the shaft.

The lower limit of the value Δ1 preferably is approximately 0.7 kgf·mm$^2$/mm·inch, and more preferably is approximately 0.8 kgf·mm$^2$/mm·inch. On the other hand, the upper limit of the value Δ1 preferably is approximately 1.6 kgf·mm$^2$/mm·inch, and more preferably is approximately 1.5 kgf·mm$^2$/mm·inch.

In addition, for example, the shaft 10 is preferably formed so that the EI value monotonically increases in a section from 150 mm to 1000 mm from the tip T. The term "monotonically increases" used here means that the EI value does not change or increases as the measurement position of the EI value moves from the tip T to the butt B of the shaft. The term "monotonically increases" includes, for example, cases in which the increased EI values form substantially a straight line and in which the increased EI values form a higher-order curve such as a quadratic curve or a cubic curve.

The position that can be measured by the above-mentioned three-point bending test and that is the closest to the tip T is at approximately 150 mm (tip stiffness). The shaft set according to the present invention is designed so that the tip rigidities at the positions 150 mm from the tips T of the shafts sequentially increases, and that the shaft used for a longer club has a higher tip stiffness at the position. In addition, the value of tip stiffness of the shaft increases at a constant rate in a range of $0.05\times10^6$ kgf·mm$^2$/inch to $0.15\times10^6$ kgf·mm$^2$/inch per inch increase in club length among the clubs using the shaft set. The lower limit of the rate of change in the value of tip stiffness of the shaft per inch increase in club length further preferably is a constant rate not less than $0.07\times10^6$ kgf·mm$^2$/inch. Meanwhile, the upper limit thereof further preferably is a constant rate not more than $0.12\times10^6$ kgf·mm$^2$/inch. With this setting, a longer club has a larger tip stiffness of the shaft, so that the swing orbit of the club head is stabilized. In comparison, a shorter club has a smaller tip stiffness of the shaft, so that the head speed is increased. The value of tip stiffness preferably is approximately $1.0\times10^6$ kgf·mm$^2$ or more, and more preferably is approximately $1.5\times10^6$ kgf·mm$^2$ or more. This is because, if the tip portion of the shaft 10 is too flexible, the launch angle of the ball when shot varies, and thus becomes unstable. On the other hand, the value of tip stiffness preferably is approximately $3.0\times10^6$ kgf·mm$^2$ or less, and more preferably is approximately $2.5\times10^6$ kgf·mm$^2$ or less. This is because, if the tip portion of the shaft 10 is too rigid, the launch angle when the ball is shot is reduced, so that the trajectory of the ball is reduced in height.

Moreover, in any portion of the shaft 10, the EI value preferably is at least approximately $1.0\times10^6$ kgf·mm$^2$, and more preferably is at least approximately $1.5\times10^6$ kgf·mm$^2$. Note that, the portion having the smallest EI value measured by the above-mentioned three-point bending test is normally at the position from 200 mm to 250 mm from the tip T of the shaft. For fastening the club head to the tip T of the shaft 10, a triangular reinforcement member is wound around the tip portion of the shaft, so that the diameter around the portion is made uniform. For this reason, the EI value is the smallest in a portion at which the reinforcement member ends. The EI value at the position from 200 mm to 250 mm from the tip T is set at the above-described value or more, so that the stability in the swing orbit of the club head can be reliably stabilized.

In any portion of the shaft 10, the EI value preferably is, at the maximum, approximately $10\times10^6$ kgf·mm$^2$, and more preferably is approximately $9.0\times10^6$ kgf·mm$^2$. The EI value is normally the highest in a portion near the butt B of the shaft 10. If the shaft is made rigid with the EI value set equal to or higher than the above-described value, it is difficult for normal golfers to cause the shaft to whip, and thus to grasp the timing to start the downswing from the top position of the swing. In addition, since the shaft does not sufficiently whip during the swing, the flying distance of the ball is reduced.

The shaft set according to the present invention is preferably designed so that a longer shaft has a lighter shaft weight, and the shaft weight decreases at a constant rate of not less than 1.5 g/inch, and particularly at a constant rate of not less than 2.0 g/inch, per inch increase in shaft length among the shafts. The upper limit of the rate of decrease in shaft weight per inch increase is a constant rate of not more than 7.0 g/inch, and particularly preferably is a constant rate of not more than 6.5 g/inch. Since the shaft used for a longer club has a lighter shaft weight, the golfer can obtain an appropriate light swing even with a long club. On the other hand, since the shaft used for a shorter club has a heavier shaft weight, the golfer can obtain an appropriate weight feel even with a short club.

The weight of the shaft 10 preferably is at most approximately 85 g, and more preferably is approximately 80 g. Reducing the weight of the shaft increases the relative weight of the head, and achieves a swing balance with which normal golfers can swing the club with a stable trajectory even with a longer club. The swing balance is preferably set at C5 to D2, and more preferably set at C8 to D0, by a 14-inch method. On the other hand, the weight of the shaft 10 preferably is at least approximately 35 g, and more preferably at least approximately 40 g. If the weight of the shaft is too light, a commonly used carbon fiber-reinforced plastic for the formation of the shaft makes the torque of the shaft too large. As a result, when the golfer using such a shaft misses a sweet spot on the golf club head, the golfer receives an impact feel that is significantly deteriorated.

The shaft 10 designed as described above is preferably formed by laminating, and then curing, plural layers of prepregs made of fiber-reinforced-plastic (FRP). Examples of the reinforcing fiber for the fiber-reinforced-plastic include: a sole carbon fiber; a composite fiber made of a carbon fiber and a fiber of another material; a metal fiber; and the like. An example of the matrix resin of the fiber-reinforced-plastic includes a thermosetting resin such as epoxy resin. The prepregs of the fiber-reinforced plastic are categorized as: a longitudinal-layer type in which fibers are arranged in parallel with the axis of the shaft; and a biased-layer type in which fibers are arranged obliquely to the axis of the shaft. The prepregs are also categorized as: a type having fibers with the same length as the total length of the shaft; and an auxiliary type having fibers with a length shorter than the total length of the shaft. The golf club shaft designed as described above may be manufactured by combining these various types of prepregs.

The shaft set for golf clubs according to the present invention may be used for a golf club set in which each golf club is formed by combining each shaft with a head for a golf club and a grip for a golf club. Each of the golf clubs preferably is a wood club such as a driver or a fairway wood.

As the golf club head (not shown), a hollow head made of metal or a head in which at least a part connected to a shaft is made of metal is generally used. The tip T of the shaft 10 is inserted by approximately 30 mm to 60 mm into a shaft-receiving opening of the hosel of the head, and is bonded and is fixed thereto with epoxy resin or the like. The iron head and the like has a sufficient bonding strength even when the shaft is inserted by only 20 mm to 25 mm. In contrast, for the driver, which has a long golf club length and a high head speed at ball impact, the shaft is preferably inserted deeper and is bonded because the driver can receive a large impact in the shot. Specifically, the position at 150 mm from the tip of the shaft corresponds to a position at approximately 100 mm from the end of the hosel toward the butt end of the grip. Accordingly, in the golf club set of the present invention, the shaft stiffness at the position 100 mm from the end of the hosel increases at a constant rate in a range of $0.05\times10^6$ kgf·mm$^2$/inch to $0.15\times10^6$ kgf·mm$^2$/inch per inch increase in club length. The lower limit of the rate of change in the shaft stiffness per inch increase in club length further preferably is a constant rate not less than $0.07\times10^6$ kgf·mm$^2$/inch. Meanwhile, the upper limit thereof further preferably is a constant rate not more than $0.12\times10^6$ kgf·mm$^2$/inch. Moreover, among the plural clubs in the golf club set of the present invention, the shaft bending stiffness at a distance of 300 mm from the butt end of each club toward the tip end thereof decreases at a constant rate of not more than $0.02\times10^6$ kgf·mm$^2$/inch per inch increase in club length.

The weight of the head preferably is at least approximately 180 g, and more preferably is at least approximately 185 g. If the weight of the head is too light, the momentum in the collision with the ball becomes so small that the initial speed of the ball cannot be increased. In particular, energy loss at the time of off-center hit increases. On the other hand, the weight of the head preferably is at most approximately 250 g, and more preferably is at most approximately 245 g. Too heavy a weight of the head causes a problem of reduced head speed. Moreover, too heavy weight of the head produces too much effect of the head, which deteriorates the swing feel.

The length of the grip (not illustrated) preferably is 300 mm, and more preferably is 280 mm. The weight of the grip preferably is 30 g to 60 g, and more preferably is 40 g to 50 g. The bore diameter of the grip preferably is 0.55 inches to 0.65 inches, and more preferably is 0.58 inches to 0.62 inches.

When the grip is fitted onto the butt portion of the shaft, the position at approximately 800 mm from the tip T comes to a vicinity of the tip of the grip. Accordingly, the section of the shaft between 600 mm and 800 mm from the tip T is closer to the grip than a portion around the center of the shaft. In this manner, the grip is fixed to the end on the butt B side of the shaft, and the end of the grip is called a butt end. On the other hand, the other end on the club head side is called a tip end. Among the clubs, the shaft bending stiffness at the distance of 300 mm from the butt end of each club toward the tip end preferably decreases at a constant rate not more than $0.02\times 10^6$ kgf·mm$^2$ per inch increase in club length.

The golf clubs including the shafts according to the present invention respectively have total weights sequentially decreasing in such a manner that a longer club has a lower total weight. The total weight of each club preferably decreases at a constant rate of not less than 6.0 g/inch, and more preferably decreases at a constant rate of not less than 6.5 g/inch, per inch increase in club length. On the other hand, the total weight of the club preferably decreases at a constant rate of not more than 9.0 g/inch, and more preferably decreases at a constant rate of not more than 8.0 g/inch, per inch increase in club length.

Each golf club of the golf club set preferably has a total length of 40 inches to 48 inches. The shaft according to the present invention allows the golfer to grasp the timing with a golf club having a long length of approximately 46 inches or longer in the same manner as that for a golf club having a normal length of approximately 45 inches. On the other hand, even when the golf club has such a length as short as 44 inches or even less, the shaft according to the present invention allows the golfer to grasp the timing in the same manner as that for the golf club having a normal length of approximately 45 inches.

It is preferable that any of the golf clubs according to the present invention have a center of gravity at a distance not exceeding 900 mm from the butt end thereof. Moreover, the center of gravity of each golf club is preferably located within 75% to 80% of its entire length from the butt end thereof. Note that the position of the center of gravity and the ratio thereof are measured by balancing the club on a plate having a sharp edge, and then by measuring the length from the balanced position (the center of gravity) to the butt end with a gauge.

EXAMPLES

Figure 2:
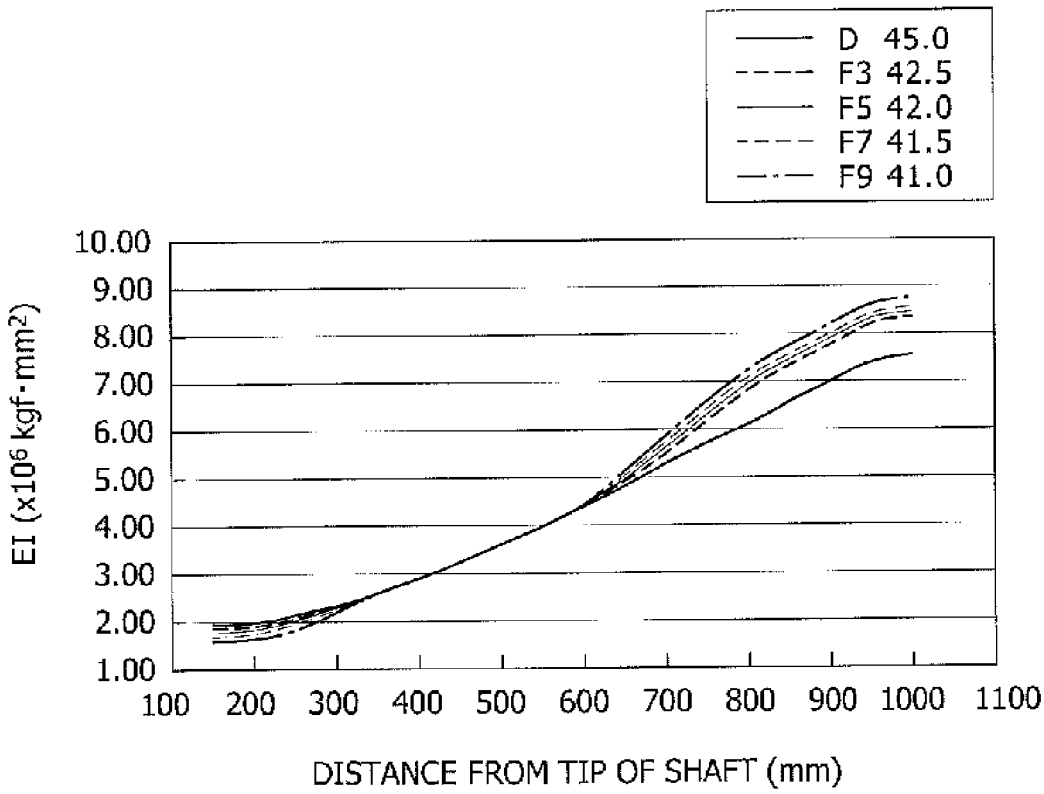
FIG. 2 is a graph showing relationships each between a distance from a tip of a shaft and a bending stiffness in a shaft set according to Example 1 of the present invention.
Figure 3:
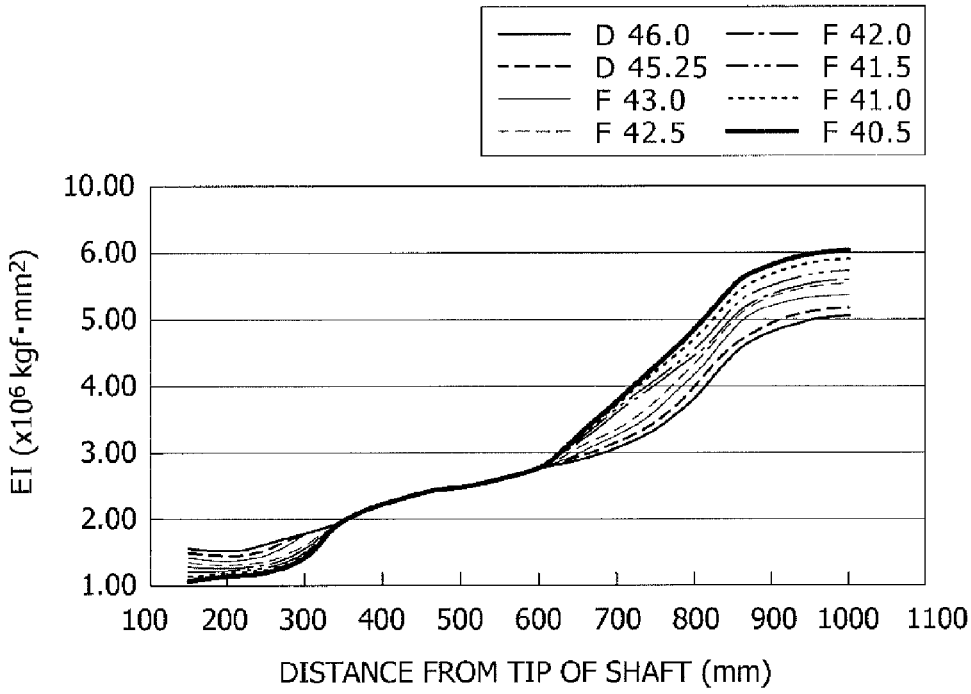
FIG. 3 is a graph showing relationships each between a distance from a tip of a shaft and a bending stiffness in a shaft set according to Example 2 of the present invention.

In order to prepare two different types of club sets, two different shaft sets (Examples 1 and 2) for use in the respective club sets were prepared. The length (in inches) of a club using each shaft, the bending stiffness (EI) at positions at 50-mm intervals starting from the tip of the shaft, and the weight (g) of the shaft, were measured. Then, the amount of change Δ1 in EI value in a section between 600 mm and 800 mm from the tip of the shaft was obtained from the measurement results of the EI value at each position. Table 1 shows these results, and FIGS. 2 and 3 each show the relationship between the bending stiffness (EI) and the distance from the tip of the shaft. Table 1 only shows the values of bending stiffness respectively at positions 150 mm, 200 mm, 550 mm, 600 mm, 650 mm, 700 mm, 750 mm, 800 mm, 850 mm, and 1000 mm, from the tip of the shaft. Note that Model 4204, manufactured by Instron Corporation, and the load cell (50 kN) were used for the measurement of the EI values. The distance between supporters on the shaft was set at 300 mm. The load and the loading rate were set respectively at 20 kg and 20 mm/min. Moreover, the indenter and each supporter used for the test were of 75R and 5R, respectively.

TABLE 1

| | | Club | Bending stiffness (EI) at the following positions (mm) from tip of shaft | | | | | | | | | | | Shaft |
|---|---|---|---|---|---|---|---|---|---|---|---|---|---|---|
| | Number | length | 150 | 200 | 550 | 600 | 650 | 700 | 750 | 800 | 850 | 1000 | Δ1 | weight |
| Example 1 | Driver | 45.0 | 1.93 | 1.96 | 4.00 | 4.41 | 4.83 | 5.28 | 5.74 | 6.11 | 6.58 | 7.55 | 8.51 | 68.5 |
| | FW#3 | 42.5 | 1.85 | 1.90 | 4.00 | 4.41 | 5.02 | 5.63 | 6.24 | 6.85 | 7.31 | 8.29 | 12.19 | 72.0 |
| | FW#5 | 42.0 | 1.73 | 1.84 | 4.00 | 4.41 | 5.06 | 5.71 | 6.35 | 7.00 | 7.46 | 8.44 | 12.94 | 73.8 |
| | FW#7 | 41.5 | 1.68 | 1.78 | 4.00 | 4.41 | 5.08 | 5.76 | 6.43 | 7.10 | 7.56 | 8.54 | 13.44 | 76.7 |
| | FW#9 | 41.0 | 1.61 | 1.62 | 4.00 | 4.41 | 5.13 | 5.85 | 6.57 | 7.29 | 7.75 | 8.73 | 14.39 | 79.2 |
| Example 2 | Driver | 46.0 | 1.58 | 1.54 | 2.63 | 2.80 | 2.90 | 3.10 | 3.40 | 3.90 | 4.56 | 5.05 | 5.51 | 46.0 |
| | | 45.25 | 1.53 | 1.49 | 2.63 | 2.80 | 2.98 | 3.17 | 3.50 | 4.03 | 4.69 | 5.18 | 6.17 | 49.8 |
| | FW#3 | 43.0 | 1.45 | 1.40 | 2.63 | 2.80 | 3.08 | 3.30 | 3.70 | 4.27 | 4.89 | 5.38 | 7.36 | 52.3 |
| | FW#4 | 42.5 | 1.37 | 1.32 | 2.63 | 2.80 | 3.10 | 3.40 | 3.85 | 4.40 | 5.06 | 5.55 | 8.01 | 54.0 |
| | FW#5 | 42.0 | 1.32 | 1.28 | 2.63 | 2.80 | 3.21 | 3.62 | 4.04 | 4.45 | 5.11 | 5.60 | 8.26 | 55.8 |
| | FW#7 | 41.5 | 1.24 | 1.25 | 2.63 | 2.80 | 3.25 | 3.70 | 4.15 | 4.60 | 5.26 | 5.75 | 9.01 | 58.0 |
| | FW#9 | 41.0 | 1.16 | 1.20 | 2.63 | 2.80 | 3.29 | 3.78 | 4.27 | 4.76 | 5.42 | 5.91 | 9.81 | 60.2 |
| | FW#11 | 40.5 | 1.08 | 1.15 | 2.63 | 2.80 | 3.32 | 3.85 | 4.37 | 4.90 | 5.56 | 6.05 | 10.51 | 64.5 |

Meanwhile, as Comparative Examples, conventional shaft sets (Comparative Example 1 and Comparative Example 2) were prepared. Then, the length of a club using each shaft, the bending stiffness (EI) at positions from the tip of the shaft, and the weight of the shaft, of the shaft sets of the Conventional Examples 1 and 2 were measured in the same manner as described above. Furthermore, the amount of change Δ1 in EI value in a section between 600 mm and 800 mm from the tip of the shaft was obtained from the measurement results of the EI values for Comparative Examples 1 and 2. Table 2 shows these results.

TABLE 2

| | Number | Club length | Bending stiffness (EI) at the following positions (mm) from tip of shaft 150 | 200 | 550 | 600 | 650 | 700 | 750 | 800 | 850 | 1000 | Δ1 | Shaft weight |
|---|---|---|---|---|---|---|---|---|---|---|---|---|---|---|
| Comparative Example 1 | Driver | 45.0 | 1.93 | 1.96 | 4.00 | 4.41 | 4.83 | 5.28 | 5.74 | 6.11 | 6.58 | 7.55 | 8.51 | 60.0 |
| | FW#3 | 42.5 | 1.93 | 1.96 | 4.00 | 4.41 | 4.83 | 5.28 | 5.74 | 6.11 | 6.58 | 7.55 | 8.51 | 58.9 |
| | FW#5 | 42.0 | 1.94 | 2.00 | 4.11 | 4.52 | 4.94 | 5.40 | 5.83 | 6.23 | 6.08 | 5.66 | 8.57 | 57.3 |
| Comparative Example 2 | Driver | 46.0 | 1.65 | 1.64 | 2.63 | 2.80 | 2.98 | 3.17 | 3.50 | 4.03 | 4.69 | 5.18 | 6.17 | 52.0 |
| | | 45.25 | 1.65 | 1.64 | 2.63 | 2.80 | 2.98 | 3.17 | 3.50 | 4.03 | 4.69 | 5.18 | 6.17 | 50.0 |
| | FW#3 | 43.0 | 1.65 | 1.64 | 2.63 | 2.80 | 2.98 | 3.17 | 3.50 | 4.03 | 4.69 | 5.18 | 6.17 | 49.5 |
| | FW#4 | 42.5 | 1.64 | 1.65 | 2.67 | 2.84 | 3.02 | 3.25 | 3.64 | 4.20 | 4.76 | 3.89 | 6.77 | 49.2 |
| | FW#5 | 42.0 | 1.64 | 1.67 | 2.71 | 2.89 | 3.07 | 3.34 | 3.77 | 4.36 | 4.83 | 2.59 | 7.36 | 48.0 |

Figure 4:
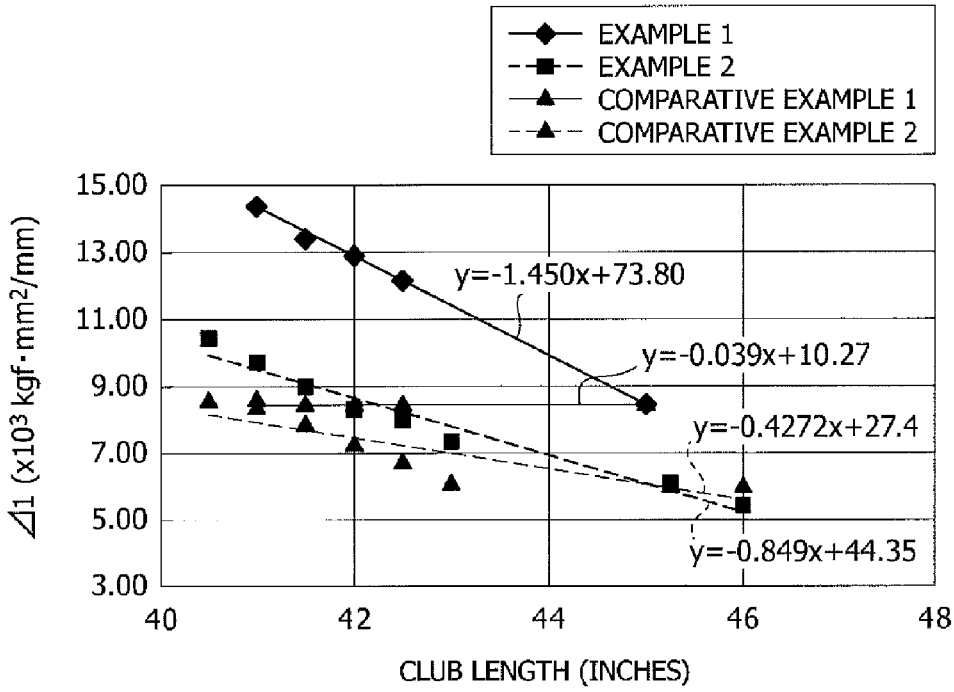
FIG. 4 is a graph showing, with approximate straight lines, relationships each between a length of a club and the amount of change (Δ1) in bending stiffness in a section between 600 mm and 800 mm from a tip of a shaft.

In addition, FIG. 4 shows the relationship between the length (in inches) of the club using each shaft and the amount of change (Δ1) in EI value in the section between 600 mm and 800 mm from the tip of the shaft in each of Examples 1 and 2 as well as Comparative Examples 1 and 2. Moreover, the measurement results of the shafts in each of Examples 1 and 2 as well as Comparative Examples 1 and 2 were plotted, so that approximate straight lines of the results were obtained. The decrease rates of Δ1 per inch increase in club length (the slopes of the approximate straight lines) of Examples 1 and 2 were 1.45 and 0.849, respectively. On the other hand, the decrease rates of Δ1 per inch increase in club length of Comparative Examples 1 and 2 were 0.039 and 0.472, respectively. Using the shaft sets of Examples 1 and 2, a club having a longer length has a smaller change in the butt stiffness, and thus allows the golfer to obtain an excellent stability of the shaft. On the other hand, a club having a smaller length has a larger change in the butt stiffness, and thus allows the golfer to obtain an excellent whip of the shaft.

Figure 5:
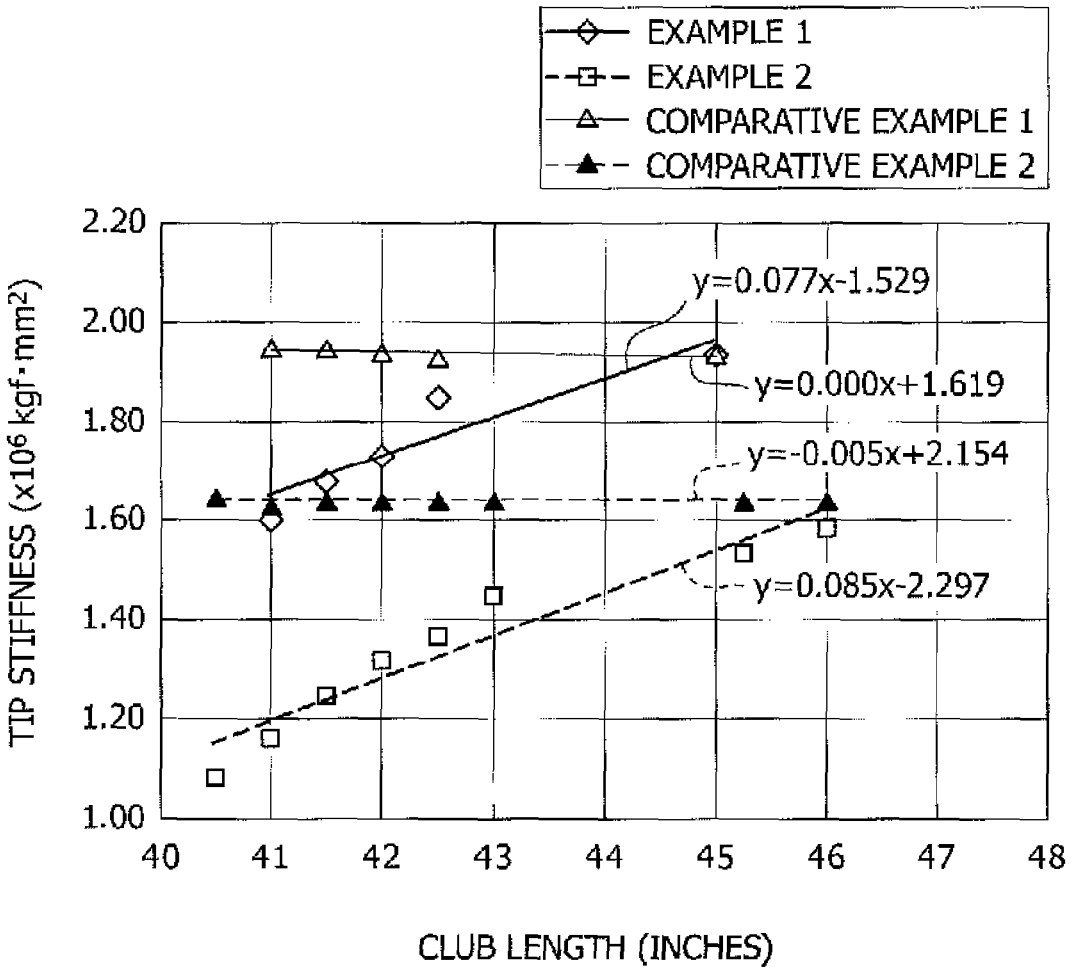
FIG. 5 is a graph showing, with approximate straight lines, relationships each between a length of a club and a tip stiffness (at 150 mm)

FIG. 5 shows the relationship between the length of each club and the tip stiffness of the corresponding shaft (at the position 150 mm from the tip of the shaft) of the club set using each of the shaft sets of Examples 1 and 2 as well as Comparative Examples 1 and 2. The measurement results of the shafts in each of Examples 1 and 2 as well as Comparative Examples 1 and 2 were plotted, so that approximate straight lines were obtained. The approximate straight lines thus obtained showed that the values of tip stiffness of Examples 1 and 2 as well as Comparative Examples 1 and 2 increased or decreased at rates of 0.077, 0.085, −0.005, and 0, respectively, per inch increase in club length. As shown in FIG. 5, in the shaft set of each of Examples 1 and 2, the longer the club using the shaft, the higher the tip stiffness.

Figure 6:
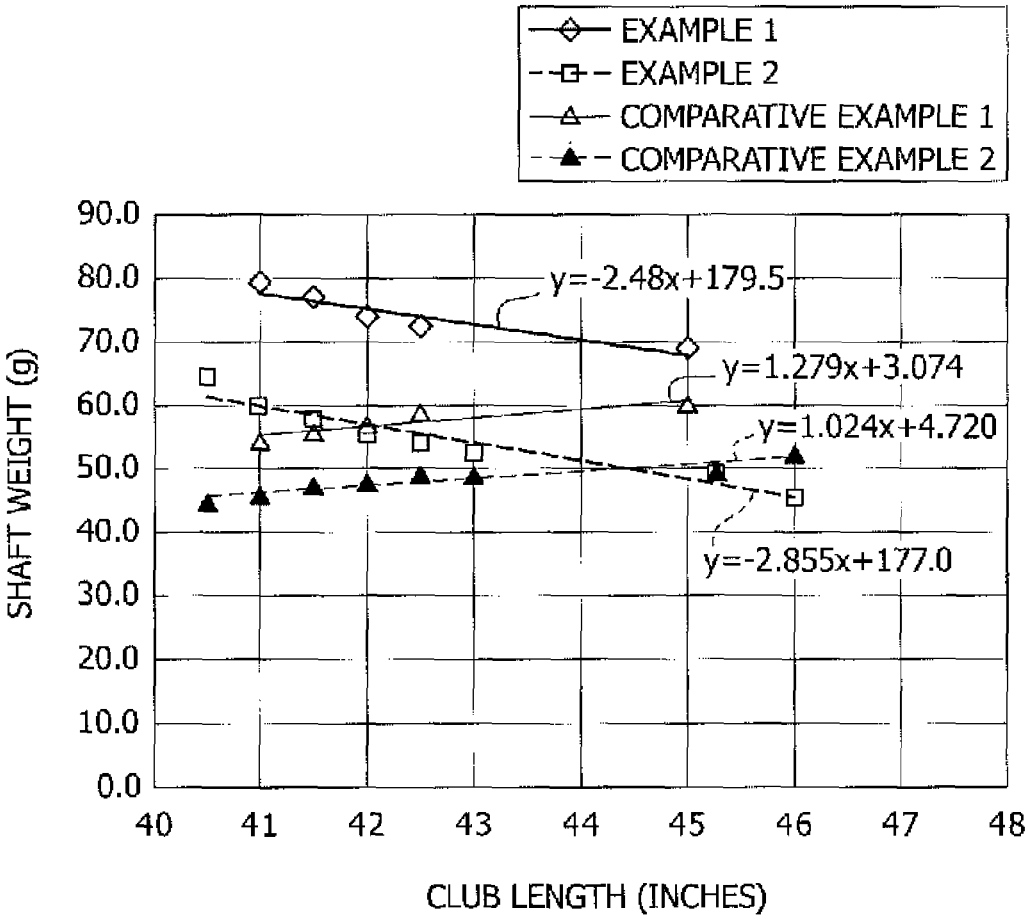
FIG. 6 is a graph showing, with approximate straight lines, relationships each between a length of a club and a weight of a shaft.

Moreover, as shown in Table 1, in the shaft set of each of Examples 1 and 2, the longer the club using the shaft, the lighter the weight of the shaft. FIG. 6 shows the relationship between the length of the club and the weight of the shaft. The measurement results of the shafts in each of Examples 1 and 2 as well as Comparative Examples 1 and 2 were plotted, so that approximate straight lines were obtained. The weights of the shafts of Examples 1 and 2 as well as Comparative Examples 1 and 2 were changed at rates of −2.487, −2.855, 1.279, and 1.024, respectively, per inch increase in club length.

Figure 7:
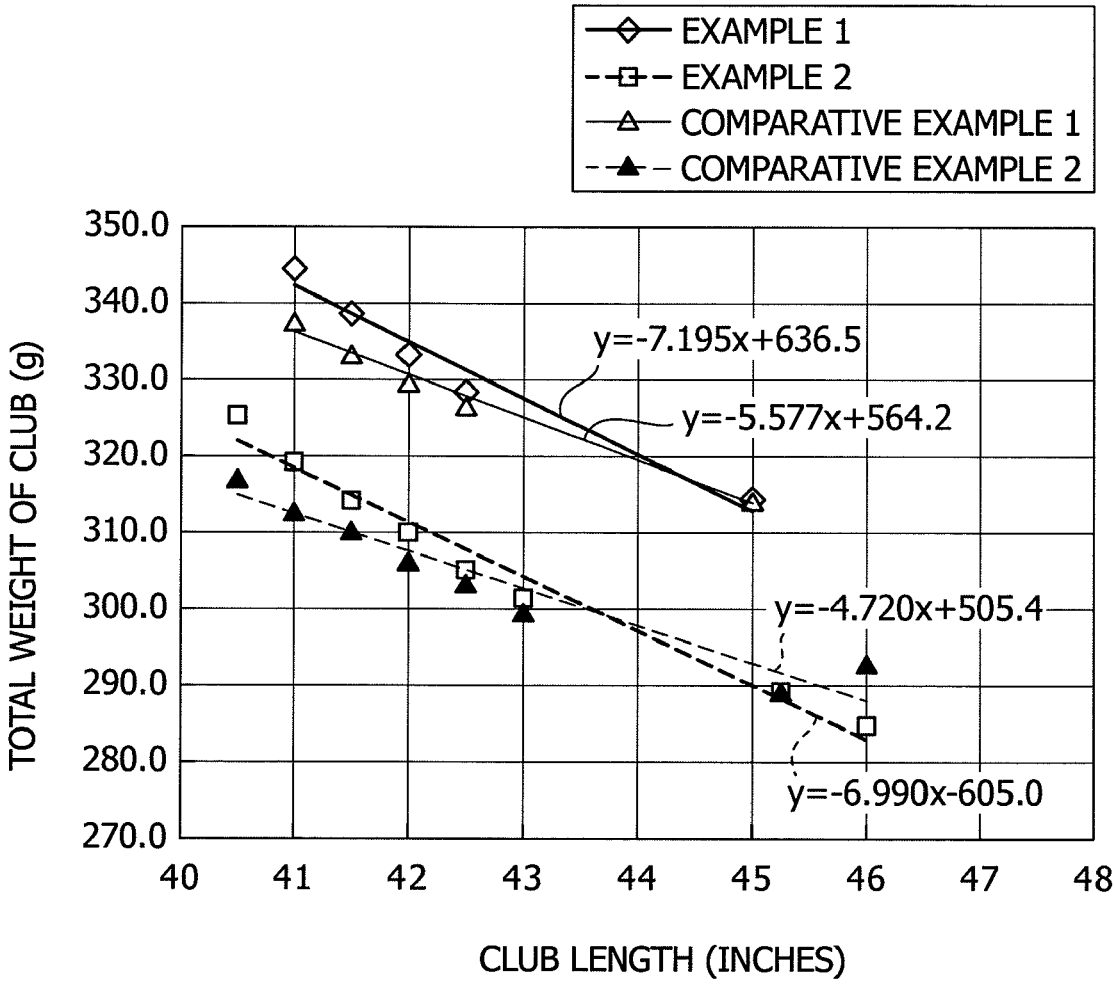
FIG. 7 is a graph showing, with approximate straight lines, relationships each between a length of a club and a total weight of the club.

As shown in Table 3, a head and a grip, corresponding to the length of each club of each of Examples 1 and 2, were fitted to its shaft so that a golf club having a length of 46 to 40.5 inches was assembled. In addition, a head and a grip were similarly fitted to each shaft of Comparative Examples 1 and 2 corresponding to each shaft of Examples 1 and 2. The total weight, the position of the center of gravity, and the ratio of the position of the center of gravity were measured for each golf club. The measurement results are shown in Table 3. Furthermore, the relationships between the lengths and the total weights of the respective clubs of Examples 1 and 2 as well as Comparative Examples 1 and 2 were plotted, so that approximate straight lines were obtained. FIG. 7 shows the approximate straight lines. The total weights of the clubs of Examples 1 and 2 as well as Comparative Examples 1 and 2 were changed at rates of 7.195, 6.999, 5.577, and 4.72, respectively, per inch increase in club length. The golfer actually swung the golf clubs having the above-described shaft sets of Examples 1 and 2, and felt that the longer the length of the club, the lighter the weight feel during swing. Moreover, the golfer obtained an appropriate weight feel because the shorter the length of the club, the heavier the weight of the shaft.

TABLE 3

| | Number | Club length [inches] | Head weight [g] | Head volume [$cm^3$] | Shaft insertion length [mm] | Grip weight [g] |
|---|---|---|---|---|---|---|
| Example 1 | Driver | 45.0 | 197.0 | 450 | 39 | 49.5 |
| | FW#3 | 42.5 | 212.0 | 163 | 33 | 49.5 |
| | FW#5 | 42.0 | 216.0 | 141 | 33 | 49.5 |
| | FW#7 | 41.5 | 221.0 | 133 | 33 | 49.5 |
| | FW#9 | 41.0 | 225.0 | 124 | 33 | 49.5 |
| Example 2 | Driver | 46.0 | 190.0 | 460 | 32 | 41.0 |
| | Driver | 45.25 | 193.0 | 460 | 32 | 41.0 |
| | FW#3 | 43.0 | 203.5 | 164 | 32 | 41.0 |
| | FW#4 | 42.5 | 206.5 | 152 | 32 | 41.0 |
| | FW#5 | 42.0 | 212.0 | 147 | 32 | 41.0 |
| | FW#7 | 41.5 | 216.0 | 133 | 32 | 41.0 |
| | FW#9 | 41.0 | 220.5 | 131 | 32 | 41.0 |
| | FW#11 | 40.5 | 225.5 | 125 | 32 | 41.0 |

TABLE 4

| Club | | | | Position of center of gravity (distance from butt end and ratio) | | | |
|---|---|---|---|---|---|---|---|
| Number | length [inches] | Club weight [g] | | Distance [mm] | Ratio [%] | Distance [mm] | Ratio [%] |
| | | Comparative Example 1 | Example 1 | Comparative Example 1 | | Example 1 | |
| Driver | 45.0 | 314 | 314 | 850 | 74.4 | 860 | 75.2 |
| FW#3 | 42.5 | 326 | 328 | 830 | 76.9 | 825 | 76.4 |
| FW#5 | 42.0 | 329 | 333 | 827 | 77.5 | 828 | 77.6 |
| FW#7 | 41.5 | 333 | 338 | 823 | 78.1 | 830 | 78.7 |
| FW#9 | 41.0 | 337 | 344 | 820 | 78.7 | 833 | 80.0 |
| | | Comparative Example 2 | Example 2 | Comparative Example 2 | | Example 2 | |
| Driver | 46.0 | 293 | 285 | 910 | 77.9 | 893 | 76.4 |
| Driver | 45.25 | 289 | 289 | 890 | 77.4 | 890 | 77.4 |
| FW#3 | 43.0 | 299 | 301 | 873 | 79.9 | 870 | 79.7 |
| FW#4 | 42.5 | 303 | 305 | 865 | 80.1 | 858 | 79.5 |
| FW#5 | 42.0 | 306 | 310 | 860 | 80.6 | 845 | 79.2 |
| FW#7 | 41.5 | 310 | 314 | 850 | 80.6 | 838 | 79.5 |
| FW#9 | 41.0 | 313 | 319 | 842 | 80.9 | 826 | 79.3 |
| FW#11 | 40.5 | 317 | 325 | 830 | 80.7 | 811 | 78.8 |

What is claimed is:

1. A shaft set comprising plural shafts used for wood type-golf clubs each having a club length of about 40 inches to about 48 inches, wherein among the plural shafts, a shaft used for a longer club has a smaller amount of change Δ1 in bending stiffness in a section from 600 mm to 800 mm from a tip of the shaft, and wherein among the clubs using the plural shafts, the amount of change Δ1 in bending stiffness decreases at a constant rate in a range of $0.7\times10^3$ kgf·mm$^2$/mm·inch to $1.6\times10^3$ kgf·mm$^2$/mm·inch per inch increase in club length, and the bending stiffness at a position 800 mm from the tip of the shaft decreases at a constant rate in a range of $0.1\times10^6$ kgf·mm$^2$/inch to $0.4\times10^6$ kgf·mm$^2$/inch per inch increase in club length.

2. The shaft set according to claim 1, wherein the plural shafts respectively have tip stiffnesses sequentially increasing in such a manner that a shaft used for a longer club has a higher tip stiffness, and wherein among the clubs using the plural shafts, the tip stiffness of the shaft increases at a constant rate in a range of $0.05\times10^6$ kgf·mm$^2$/inch to $0.15\times10^6$ kgf·mm$^2$/inch per inch increase in club length.

3. The shaft set according to claim 1, wherein the plural shafts respectively have shaft weights sequentially decreasing in such a manner that a shaft used for a longer club has a smaller shaft weight, and wherein among the clubs using the plural shafts, the shaft weight decreases at a constant rate in a range of 1.5 g/inch to 7.0 g/inch per inch increase in club length.

4. A golf club set comprising plural golf clubs each having a length of 40 inches to 48 inches, the plural golf clubs comprising the shaft set according to claim 1.

5. The golf club set according to claim 4, wherein among the plural clubs, a shaft bending stiffness at a distance of 300 mm from a butt end of each club toward a tip thereof decreases at a constant rate of not more than $0.02\times10^6$ kgf·mm$^2$/inch per inch increase in club length.

6. The golf club set according to claim 4, wherein the plural clubs respectively have club weights sequentially decreasing in such a manner that a longer club has a lighter club weight, wherein the club weight decreases at a constant rate in a range of 6.0 g/inch to 9.0 g/inch per inch increase in club length, and wherein the center of gravity of each of the clubs is located within 75% to 80% of its entire length from the butt end of the club, and also is located at a distance not exceeding 900 mm from the butt end thereof.

* * * * *